US011703291B2

(12) United States Patent
Huang

(10) Patent No.: US 11,703,291 B2
(45) **Date of Patent: *Jul. 18, 2023**

(54) RECOILLESS AUTOMATIC FIREARM

(71) Applicant: Zhisong Huang, Fremont, CA (US)

(72) Inventor: Zhisong Huang, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/661,499

(22) Filed: Apr. 29, 2022

(65) Prior Publication Data

US 2022/0260329 A1 Aug. 18, 2022

Related U.S. Application Data

(63) Continuation-in-part of application No. 17/100,862, filed on Nov. 21, 2020, now Pat. No. 11,346,621.

(60) Provisional application No. 63/094,835, filed on Oct. 21, 2020.

(51) Int. Cl.
*F41A 1/10* (2006.01)
*F41A 1/08* (2006.01)

(52) U.S. Cl.
CPC ..... *F41A 1/10* (2013.01)

(58) Field of Classification Search
CPC ..... F41A 9/35; F41A 1/08; F41A 1/10
See application file for complete search history.

(56) References Cited

U.S. PATENT DOCUMENTS 1,108,715 A * 8/1914 Davis ..... F41A 1/10 89/1.701
1,108,716 A * 8/1914 Davis ..... F41A 1/10 89/1.702
1,108,717 A 8/1914 Davis
1,394,490 A * 10/1921 Giles ..... F41A 21/00 89/27.11
3,633,509 A * 1/1972 Grandy ..... F42B 10/56 102/338
4,126,078 A * 11/1978 Ashley ..... F42B 5/16 102/440
4,452,123 A * 6/1984 Holtrop ..... F42B 5/26 89/33.03
5,313,870 A * 5/1994 Clark ..... F41A 1/10 89/1.701
5,357,841 A * 10/1994 Clark ..... F41A 1/08 89/1.703

(Continued)

OTHER PUBLICATIONS

"U.S. Appl. No. 17/100,862, Notice of Allowance dated Feb. 1, 2022", 16 pgs.

(Continued)

*Primary Examiner* — Derrick R Morgan

(74) *Attorney, Agent, or Firm* — Schwegman Lundberg & Woessner, P.A.

(57) ABSTRACT

An automatic recoilless firearm comprising a gun barrel and a compensating mass launch tube in which a projectile is accelerated in one direction inside said gun barrel counterbalanced by a compensating mass accelerated in the opposite direction inside said launch tube thereby minimizing recoil and further providing means of automatic ammunition handling. Said firearm further comprises a bolt or bolts and barrels configured to reduce or eliminate transmission of momentum and mechanical energy to the gun barrels and/or gun body during an operation of the firearm.

29 Claims, 11 Drawing Sheets

(56) References Cited

U.S. PATENT DOCUMENTS

| | | | | |
|---|---|---|---|---|
| 7,398,614 | B2 * | 7/2008 | Rozhkov | F41A 21/12 42/2 |
| 7,418,896 | B1 * | 9/2008 | Dindl | F41A 19/13 89/1.701 |
| 7,624,668 | B1 | 12/2009 | Sanford | |
| 7,814,696 | B2 * | 10/2010 | Rapp | F41A 19/65 42/84 |
| 7,997,179 | B1 | 8/2011 | Nelson et al. | |
| 2011/0296977 | A1 * | 12/2011 | Regebro | F41A 1/10 89/1.701 |
| 2020/0200499 | A1 * | 6/2020 | Lindström | F41A 21/30 |
| 2021/0131756 | A1 * | 5/2021 | Shaughnessy | F41A 1/10 |
| 2022/0120523 | A1 * | 4/2022 | Huang | F41A 1/10 |
| 2022/0373277 | A1 * | 11/2022 | Kipnis | B64D 7/06 |

OTHER PUBLICATIONS

"U.S. Appl. No. 17/100,862, Response filed Jan. 5, 22 to Restriction Requirement dated Nov. 5, 2021", 2 pgs.
"U.S. Appl. No. 17/100,862, Restriction Requirement dated Nov. 5, 2021", 5 pgs.

* cited by examiner

RECOILLESS AUTOMATIC FIREARM

CROSS-REFERENCE TO RELATED APPLICATIONS

This application is a continuation-in-part of and claims the benefit of priority to U.S. application Ser. No. 17/100,862, filed Nov. 21, 2020, which claims the benefit of priority to U.S. Provisional Application Ser. No. 63/094,835, filed Oct. 21, 2020, the benefit of priority of each of which is claimed herein, and which applications are hereby incorporated herein by reference in their entirety.

TECHNICAL FIELD

The present disclosure relates to ordnance, ammunitions, and firearms. Particularly, the disclosure relates to reduced-recoil and recoilless firearms.

BACKGROUND

In operating a firearm, a weapon holder must provide and maintain aim. As a result, momentum and mechanical energy transmitted from the firearm during shooting must be absorbed and countered by the weapon holder. Meeting this requirement is a challenge for a firearm operator, particularly one not firmly anchored to the ground. It is therefore desirable to minimize the amount of the transmission that occurs during shooting.

The biggest source of the momentum and mechanical energy is recoil from the launching of a projectile. The previous patent discloses a device that can be used to cancel recoil from the projectile launching while providing automatic operation. Unfortunately, the automatic operation of a firearm also produces recoils that need to be further reduced or eliminated and is an object of some example embodiments.

For an automatic firearm, the reciprocating action of the bolt group is a significant source of the momentum and mechanical energy, very often comparable in magnitude to that resulting from a projectile launching. For example, upon firing a typical gun, the bolt group is driven backward, helping to extract and then eject spent shell casings in the recoil phase of the reciprocating motion. At the end of the recoil phase, though, the bolt group collides with a physical stop, transferring momentum and at least part of the kinetic energy to the gun body, which causes a rearward movement and often a sharp muzzle rise. The returning bolt group then feeds an ammunition into the gun chamber and readies the firearm for a subsequent ignition. At the end of this feed phase, the bolt group hits the gun barrel, again transferring momentum and mechanical energy to the gun barrel and body, which produces a forward gun movement and often a sharp muzzle dip. These vibrations, and the transmitted momentum and mechanical energy, degrade aim as well as controllability of the firearm and therefore need to be beneficially reduced or eliminated.

Another important source is the momentum and mechanical energy imparted to the gun barrels during shooting. For example, in a recoil-operated gun system, the gun barrel absorbs momentum and mechanical energy from the shooting and is made to reciprocate in ways analogous to the bolt groups. Transmission of these mechanical motions to the gun body also needs to be reduced or eliminated to improve shooting accuracy and to benefit ease of operations.

BRIEF DESCRIPTION OF THE DRAWINGS

The following description includes discussion of figures having illustrations given by way of example of implementations of embodiments of the disclosure. The drawings should be understood by way of example, and not by way of limitation. As used herein, references to one or more "embodiments" are to be understood as describing a particular feature, structure, or characteristic included in at least one implementation of the inventive subject matter. Thus, phrases such as "in one embodiment" or "in an alternate embodiment" appearing herein describe various embodiments and implementations of the inventive subject matter, and do not necessarily all refer to the same embodiment. However, they are also not necessarily mutually exclusive. To easily identify the discussion of any particular element or act, the most significant digit or digits in a reference number refer to the figure ("FIG.") number in which that element or act is first introduced.

FIG. 2A contains a perspective view and a top view of the cartridge. FIG. 2B is a cross-sectional view. FIG. 2C is a schematic cross-section view of a cartridge alternatively constructed in accordance with some example embodiments.

FIG. 7A depicts a configuration of a firearm when cocked, in accordance with some example embodiments. FIG. 7B illustrates the firearm nearing end of a feed phase. FIG. 7C shows configuration of the firearm nearing end of the recoil/ejection phase.

FIG. 8A depicts configuration of the firearm when cocked. FIG. 8B illustrates the firearm nearing end of the feed phase for the targeting launch. FIG. 8C shows a configuration of the firearm nearing end of the targeting spent ammo ejection and compensating ammo feed phase.

FIG. 9A depicts a configuration of the firearm at the start of a firing cycle. FIG. 9B depicts the configuration of the firearm shortly after both the targeting and compensating cartridges are simultaneously discharged. FIG. 9C depicts the configuration nearing end of a recoil/ejection phase. FIG. 9D illustrates the configuration nearing end of ammunition feed phase for both the targeting and compensation barrels. FIG. 9E depicts configuration of the firearm when both the targeting and compensating cartridges are simultaneously discharged shortly prior to both barrels reaching respective battery stations.

FIG. 10A depicts configuration of the firearm at the beginning of a firing cycle. FIG. 10B illustrates the firearm configuration shortly after the targeting cartridge is discharged. FIG. 10C shows configuration of the firearm shortly after the compensating cartridge is discharged. FIG. 10D depicts configuration of the firearm nearing end of an ejection phase for both the barrels.

Descriptions of certain details and implementations follow, including a description of the figures, which may depict some or all of the embodiments described below, as well as discussing other potential embodiments or implementations of the inventive concepts presented herein. An overview of embodiments of the disclosure is provided below, followed by a more detailed description with reference to the drawings.

DETAILED DESCRIPTION

In the following description, for the purposes of explanation, numerous specific details are set forth in order to provide an understanding of various embodiments of the inventive subject matter. It will be evident, however, to those skilled in the art, that embodiments of the inventive subject matter may be practiced without these specific details. In general, well-known instruction instances, structures, and techniques are not necessarily shown in detail.

Figure 1:
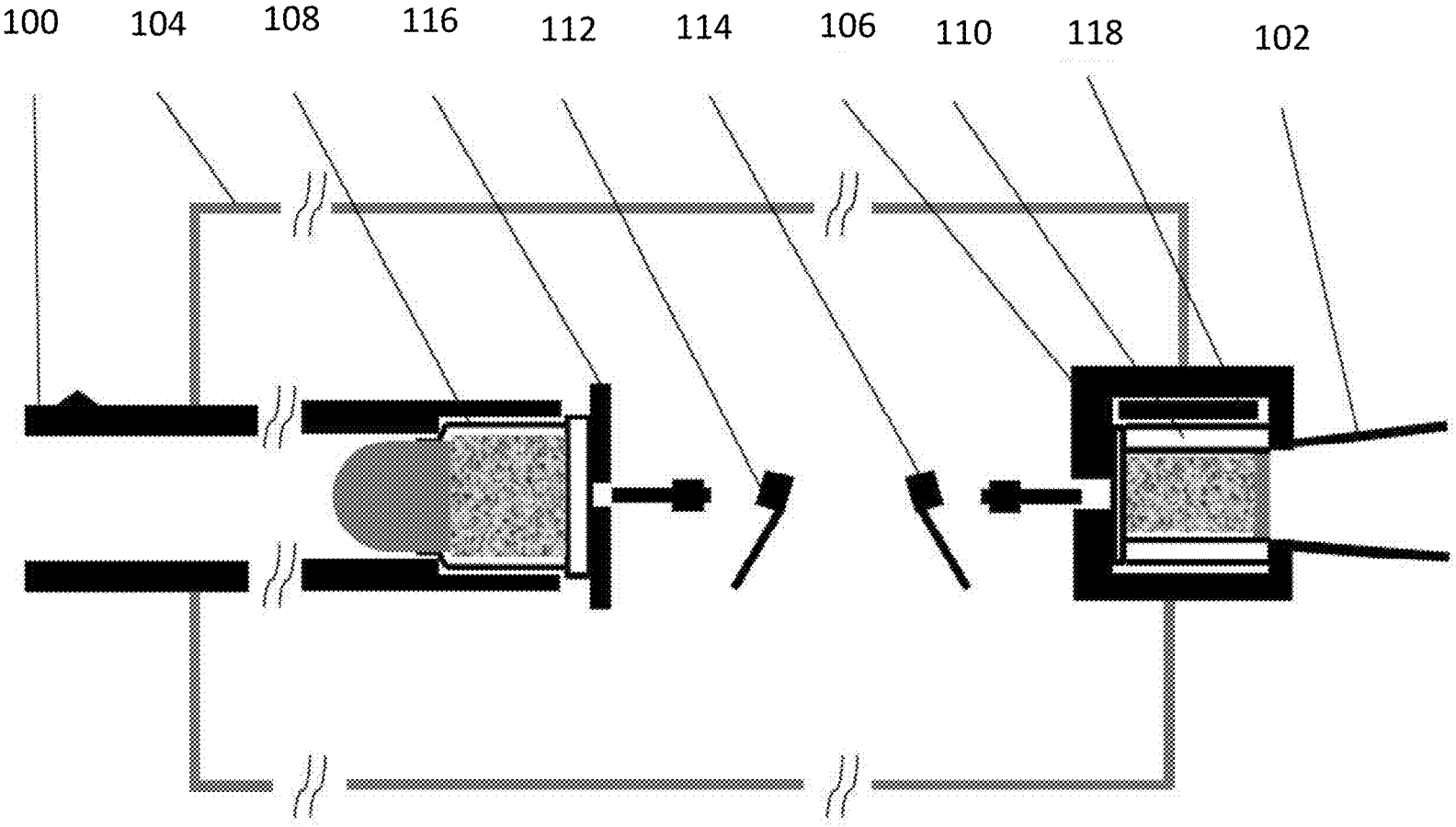
FIG. 1 is a schematic diagram of a recoilless apparatus for guns constructed in accordance with some example embodiments.

As depicted in FIG. 1, an embodiment comprises a gun barrel 100 and a compensating mass launch tube 102, each pointing in an opposite direction, are supported breech-to-breech substantially coaxially linearly during at least the firing, using a fixture 104. Herein, coaxial linearity refers to the geometric alignment wherein the axis of said barrel and tube coincide in a line. Each said barrel and tube is open at each breech end and muzzle end. Sufficient gap in space is allocated between said breech ends such that breech loading and/or unloading plus ammunition triggering can be accommodated for each said barrel and tube in at least the duration of said loading and/or unloading and/or in the duration of said ammunition firing. A compensating mass loading chamber 106 is further attached fixedly to breech end of said launch tube 102. Said gun barrel 100 is used to deliver a projectile to a target, while said launch tube 102 is used to supply needed compensating mass movement.

In a preferred embodiment, when loaded, a cartridge 108 sits inside said gun barrel 100 at its breech end, while a compensating mass blank cartridge 110 (e.g., second cartridge, obround cartridge, blank cartridge) sits inside said loading chamber 106 at the breech end of said tube 102.

Gun barrel 100 is furnished striking device, such as hammer head 112 (e.g., hammer, pin) and tube 102 is furnished with a hammer head 114. Each said hammer head is connected to a pull trigger. Pulling of said triggers leads to firing of said cartridge and/or packages by means of concussion ignition. Barrel 100 is mated to a conventional cartridge handling and firing mechanism, the construction and operations of which are abundantly depicted in common literatures. During firing, high pressure propellant gas propels the projectile forward as well as expanding the casting of the cartridge 108. This expansion helps sealing the breech end of said barrel 100. Near the end of firing, a recoil-powered mechanism comprising part 116 extracts the spent casing as well as loading a fresh cartridge. There are many different mechanical methods available by which an automatic ammunition handling is carried out most of which share the feature that the mechanical motions involved are initiated and energized by the gun firing. Said tube 102 is mated to an open chamber cartridge handling system comprising cylindrical hollow section 118 and is described subsequently.

Figure 2C:
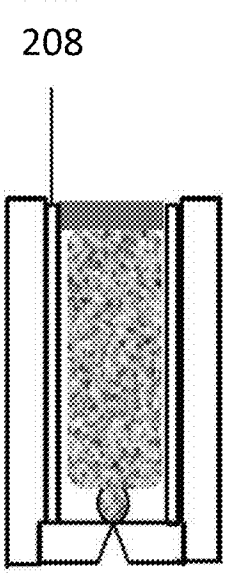
FIGS. 2A-C are schematic examples of a half-obround cartridge used for launching a compensating mass.
Figure 2B:
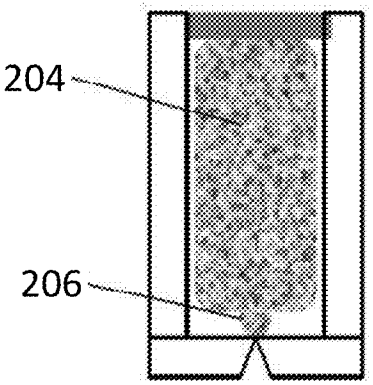
Figure 2A:
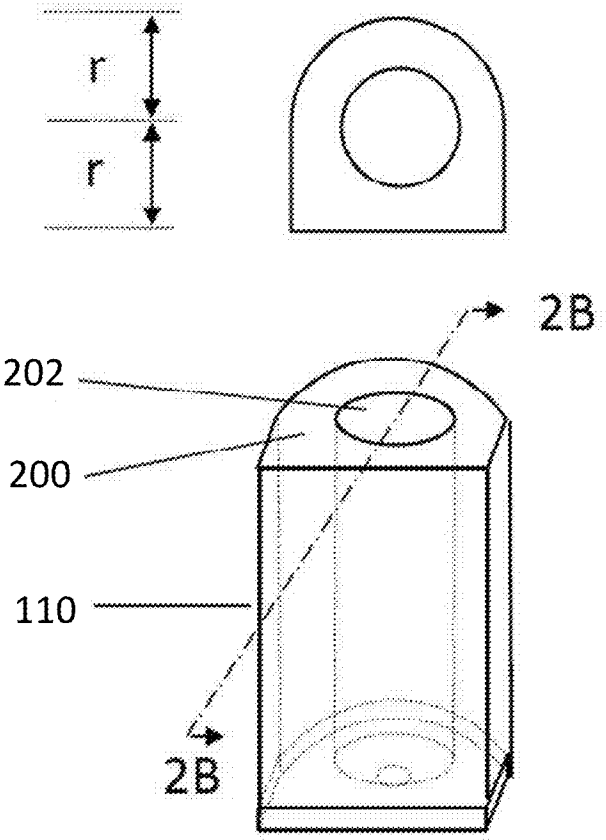

Said compensating mass blank cartridge 110 is illustrated. Said compensating mass blank cartridge 110 comprises a shell casing 200 the exterior geometry of which is characterized by that of a half-obround, consisting of a rectangular prism section and a semicylindrical section overlaying said prism section, wherein height of said prism is further equal to radius of said semicylinder as shown in FIG. 2A. Said shell casing 200 further comprises a cylindrical hollow section 202, in which a gun powder 204 and a primer 206 may be contained as depicted in FIG. 2B. Said cylindrical hollow section 118 is further disposed to be coaxial with said semicylinder. In another preferred embodiment, as depicted in section 2C, said compensating mass blank cartridge 110 further comprises a conventional cylindrical cartridge 208 inserted into said hollow section. In some example embodiments, said the material of shell casing 200 comprises a polymer.

Figure 3:
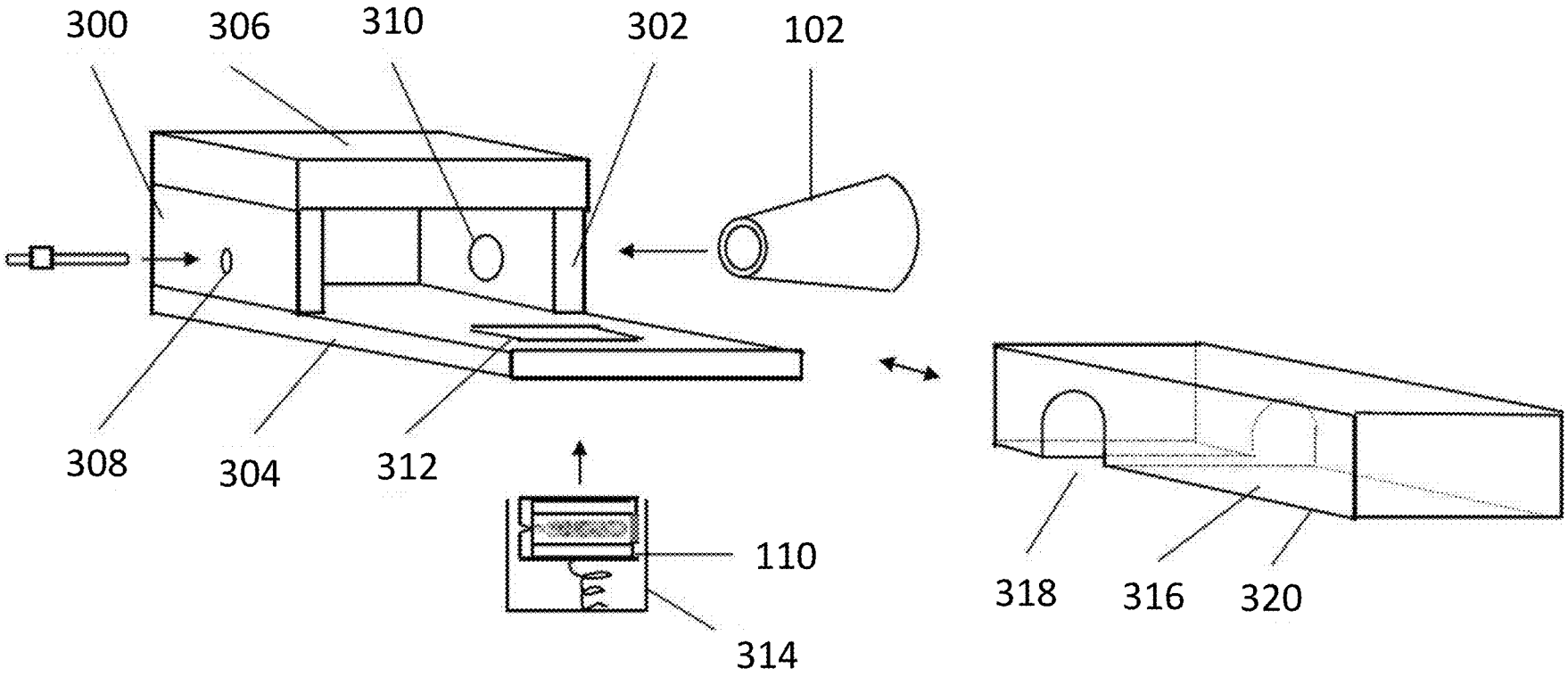
FIG. 3 is a schematic drawing of one example of a loading chamber and a compensating mass launch tube to which said loading chamber is attached.

FIG. 3 depicts details of said loading chamber 106. In preferred embodiments, said loading chamber 106 comprises: a tunnel open at both longitudinal ends; and a first vertical sidewall 300; and a second vertical sidewall 302; and a first horizontal sidewall 304; and a second horizontal sidewall 306. A small hole 308 is formed on sidewall 300 for admitting a concussion firing pin. A larger circular opening 310 is formed on sidewall 302 for connecting fixedly to said launch tube 102. In some example embodiments, the openings (e.g., small hole 308, circular opening 310) and tube 102 are disposed to be coaxially linear. A slot opening 312 is further formed on sidewall 304 whereby loading of a compensating mass blank cartridge 110 from a magazine 314 can be accomplished.

A carrier slider 316 is utilized for purpose of ammunition loading and/or unloading. Said slider is moved slidably longitudinally inside said tunnel, carrying the compensating mass blank cartridge 110 (e.g., half- obround cartridge) held inside a trench 318 formed transversely on a first horizontal surface 320 of said slider. Transverse cross-section of said slider is characterized by an exterior dimension the same as that of said tunnel such that each sidewall surface of said slider is contiguous to a counterpart sidewall surface of said tunnel. Trench 318 is characterized by a geometry and dimension the same as that of said half-obround cartridge such that each sidewall surface of a loaded cartridge is contiguous to a counterpart surface of said trench and said first horizontal sidewall 304 of said tunnel.

Said trench 318 is further transversely disposed in said slider such that semicylindrical section of said trench 318 is coaxially linear to said tube 102 when positioned at a station of firing, thereby completing formation of an enclosed loading chamber 106.

In one preferred embodiment, said tunnel is longitudinally linear. Said tunnel sidewalls are therefore suitably planar. Counterpart surfaces of said slider and half-obround cartridge are accordingly planar to maintain contiguity. In another preferred embodiment, said tunnel is arced longitudinally, in which case relevant sidewalls of the tunnel, slider and cartridge are accordingly arced to maintain contiguity.

Figure 4:
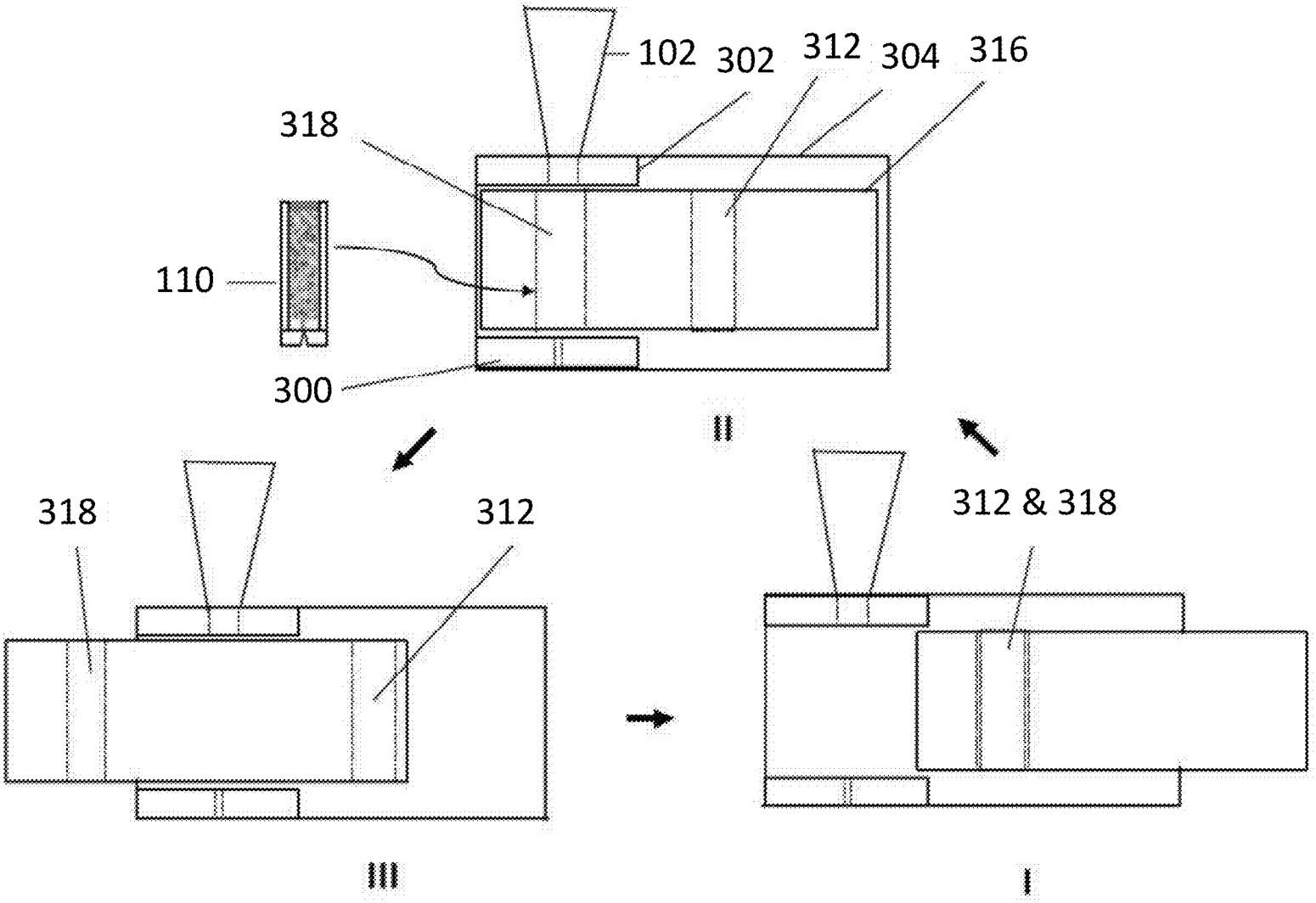
FIG. 4 is a schematic drawing of one example of top-down view of the loading chamber showing the carrier slider at stations of ammunition loading, firing, and unloading respectively.

FIG. 4 depicts an example of loading chamber 106 wherein carrier slider 316 is positioned at stations of loading (I) a cartridge, firing (II) a cartridge and unloading (III) a spent shell respectively. Compensating mass blank cartridge 110 is carried by said slider 316 but not displayed for sake of clarity. At station (I), slot opening 312 and trench 318 are lined up and the compensating mass blank cartridge 110 is laterally inserted into trench 318. Slider 316 is then moved to station (II) carrying the loaded cartridge into coaxially linear alignment with launch tube 102. Front surface of the compensating mass blank cartridge 110 is contiguous to tunnel sidewall 302 and rear surface of said cartridge is further contiguous to sidewall 300, thereby sealing breech end of launch tube 102. After launching, slider 316 is moved to station (III) for ejection of spent shell casings. A new cycle can start after a slider 316 is positioned again at station (I). In preferred embodiments, only one slider is included. Alternatively, multiple sliders may be chained together for faster executions and may further be moved in a circular loop.

In one preferred embodiment, means are provided whereby automatic operations comprising ammunition handling of said launch tube 102 are initiated and energized by its own launch recoil. In another preferred embodiment, means are provided whereby automatic operations of launch tube 102 are initiated and energized by an external electric power source. In a more preferred embodiment, launch tube 102 is slaved to said gun barrel 100 and means are provided whereby automatic operations of said tube are initiated and energized by recoil from firing of said gun 100.

An object of said fixture 104 is to maintain coaxial linearity of said gun barrel and launch tube. For launching a large bore high impact projectile, requirements for structural integrity of the fixture could be impractically high and failures in ignition synchronization of two separate charges could produce catastrophic recoil impact on the weapon holder. For launching smaller caliber projectiles, on the other hand, maintaining structural integrity is feasible with existing construction materials and relatively small imbalance caused by occasional failures in firing synchronization is tolerable. Relatively large movement along said coaxial axis may be permitted, should such benefits shock absorption. It is known that a major recoil shock happens the moment the supersonic projectile and gaseous propellant leaves the barrel and/or launch tube at muzzle points. In one preferred embodiment, said fixture 104 connects said gun barrel and launch tube via contacts near muzzle points and further utilizes appropriate shock absorbing mechanisms contained in said fixture. Said shock absorbing mechanisms may include elastomers, springs and various other shock-absorbers. In another preferred embodiment said barrel/launch tube are further connected via contacts near breech points, taking advantage of shock absorbers already built into existing guns.

A recoil-reducing muzzle brake further included on said gun barrel 100 further reduces the size of needed compensating mass package and reduces size of needed device launching said package, thereby further reducing weight of said recoilless apparatus. Commercial muzzle brakes are widely available and can be chosen for this purpose.

Figure 5:
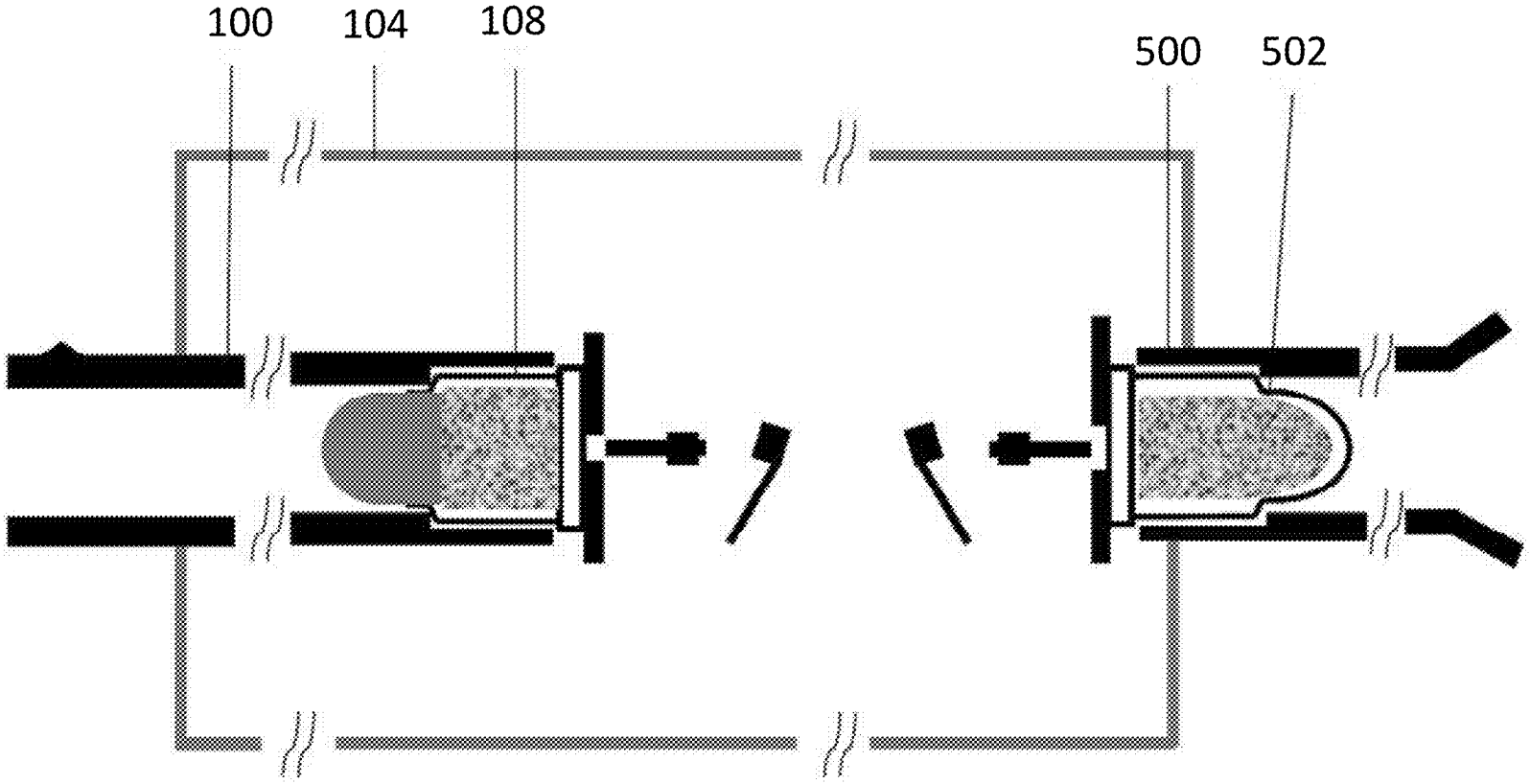
FIG. 5 is a schematic diagram of a recoilless apparatus for guns constructed in accordance with some example embodiments

FIG. 5 is a schematic diagram of a recoilless apparatus for guns in accordance with some example embodiments. In this embodiment, a first gun barrel 100 for launching a projectile and a second gun barrel 500 for launching a compensating mass, each pointing in an opposite direction, are supported breech-to-breech coaxially linearly during at least the gun firing, using a fixture 104. Each said barrel is open at each breech end and muzzle end. In some example embodiments, a sufficient gap in space is allocated between said breech ends, in at least the duration of said loading and/or unloading, and/or in the duration of said ammunition firing, such that an automatic ammunition handling device, comprising means for breech loading and/or unloading of ammunitions and ammunition triggering, can be mated to each said barrel. A first cartridge 108 is placed inside said first gun barrel 100 at its breech end and further seals said breech end. A second cartridge or blank cartridge 502 is placed inside said second gun barrel 500 at its breech end and further seals said breech end. A first loader is mated to said first gun barrel providing means of loading and/or unloading of said cartridge, wherein said loader is powered generally by recoil resulting from firing of said cartridge 108. A second loader is mated to said second gun barrel providing means of loading and/or unloading of said cartridge or blank cartridge, wherein said loader is powered generally by recoil resulting from firing of said cartridge or blank cartridge 502. An ignition device is provided whereby charges inside said cartridges are ignited substantially simultaneously or with a pre-determined time lag. A timing device is provided supplying suitable means of adjusting said time lag.

In preferred embodiments, each gun barrel is associated with a hammer head. Each said hammer head is connected to a pull trigger. The pulling of said trigger leads to firing of said cartridge by means of concussion triggering. Each pull trigger is operated by an electronic actuator, which pulls the trigger upon receiving an electric pulse. An electronic device provides electric pulses for each actuator simultaneously or with a pre-determined time lag. In one preferred embodiment, both guns are fired simultaneously. In another preferred embodiment, the second gun is fired with a time delay relative to the first gun such that the first projectile already moves outside the barrel before the second gun is fired.

Many automatic ammunition handling devices and/or mechanisms are commercially available for guns and they can be chosen for this purpose. In preferred embodiments, each gun barrel is mated to an automatic ammunition loader wherein operations of each loader are initiated and energized by firing of each respective gun. In a more preferred embodiment, loader operations of the second barrel are slaved to the first barrel, and further are initiated and energized by firing of said first gun. Said first gun barrel may comprise a muzzle brake to further reduce its recoil thereby reducing size of said second gun barrel and additionally size of second cartridge or blank cartridge.

Recoilless apparatus depicted in FIG. 5 may utilize components that are currently in widespread use and have been proven reliable. Recoilless apparatus constructed in accordance with this alternative embodiment have an advantage of compatibility with existing logistics. While this device has been described in terms of what are at present believed to be the preferred embodiments, it will be apparent to those skilled in the art that various changes may be made to these embodiments without departing from the scope of some example embodiments. For example, some embodiments have been described utilizing an ammunition triggering method based on concussion. It will become obvious to one skilled in the art to recognize that the device can also be practiced utilizing an electrical triggering method. It is therefore intended that the appended claims cover all changes that fall within the scope of some example embodiments.

As discussed, it is an object of the present embodiments to provide a recoilless firearm capable of automatic ammunition handling and firing. A further object is to improve aiming and controllability of the firearm by reducing or substantially eliminating transmission of momentum and mechanical energy: from the reciprocating bolt groups to the gun barrels and body; and from the oscillating gun barrels to the gun body during shooting. This latter object is the focus of the present disclosure.

In some example embodiments, a firearm device comprises a first gun barrel for launching a projectile and a second gun barrel for launching a compensating mass, each pointing in an opposite direction, are supported breech-to-breech coaxially linearly during at least the gun firing, using a fixture. In some example embodiments, each said barrel is open at each breech end and muzzle end. Sufficient gap in space is allocated between said breech ends, in at least the duration of said loading and/or unloading, and/or in the duration of said ammunition firing", such that an automatic ammunition handling device, comprising means of breech loading and/or unloading of ammunitions and ammunition triggering, can be mated to each said barrel. A first cartridge is placed inside said first gun barrel at its breech end and further seals said breech end. A second cartridge or blank cartridge is placed inside said second gun barrel at its breech end and further seals said breech end. A corresponding amount of charge is contained in each said cartridge such that each said barrel produces substantially the same magnitude of recoil. A first loader is mated to said first gun barrel providing means of loading and/or unloading said first cartridge, wherein said loader is powered generally by recoil resulting from firing of said first cartridge. A second loader is mated to said second gun barrel providing means of loading/unloading said second cartridge or blank cartridge, wherein said loader is powered generally by recoil resulting from firing of said second cartridge or blank cartridge. An ignition device is provided whereby charges inside said cartridges are ignited substantially simultaneously or with a pre-determined time lag.

Figure 6:
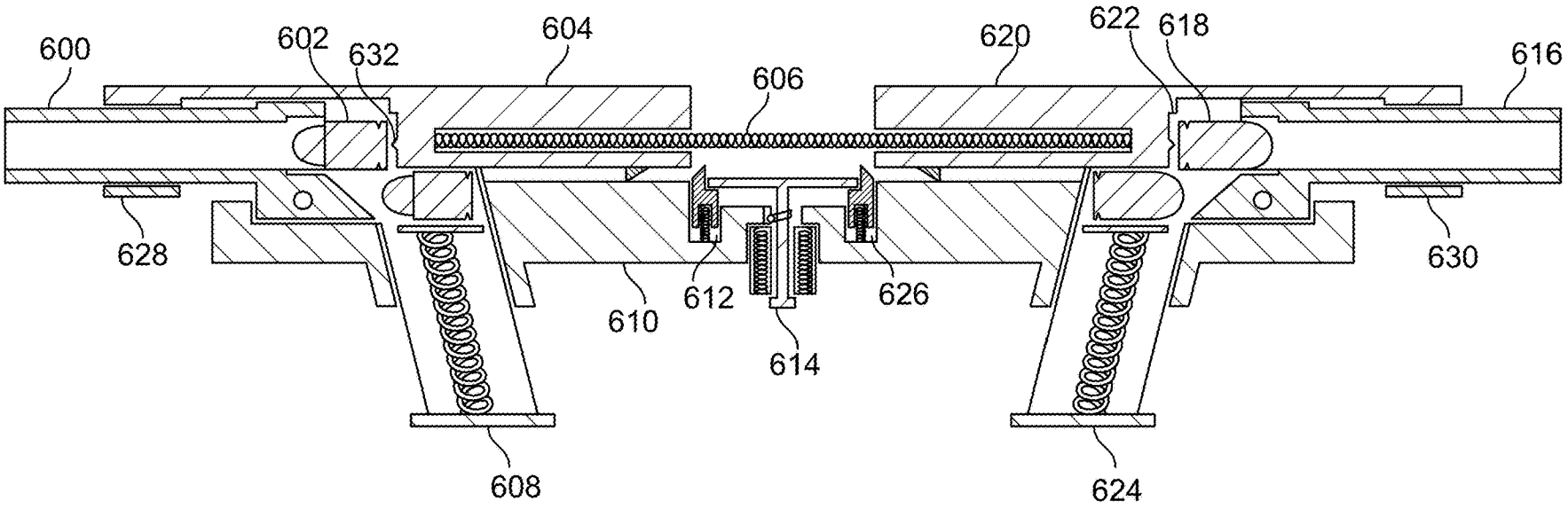
FIG. 6 is a schematic cross-sectional diagram of an example of an automatic recoilless firearm constructed in accordance with some example embodiments

With reference to FIG. 6, as illustrated, a targeting gun barrel 600 and a compensating gun 616, each pointing in an opposite direction, are fixedly mounted coaxially linearly on a gun body 610 (e.g., gun receiver). In some example embodiments, the compensating gun barrel 616 has a varying inner diameter along the length of the compensating barrel 616. A targeting cartridge 602 and a compensating blank cartridge 618 are also provided. Said targeting and compensating cartridges are configured to produce substantially the same recoil when discharged. Bolts 604 and 620 are configured to be capable of colliding with each other (e.g., elastic collision, inelastic collision) without encountering limit stops 628 and 630 respectively. In some example embodiments, a compression spring 606 (e.g., recoil spring) connects both bolts. Fixed firing pins 632 and 622 are employed. Movable firing pins are utilized in other embodiments discussed in later sessions. Sears 612 and 626 provides gating control of the bolt movements. A solenoid-operated trigger assembly 614 connected to said sears furnishes firing control. Finally, magazines 608 and 624 supplies targeting and compensating cartridges respectively.

Figure 7A:
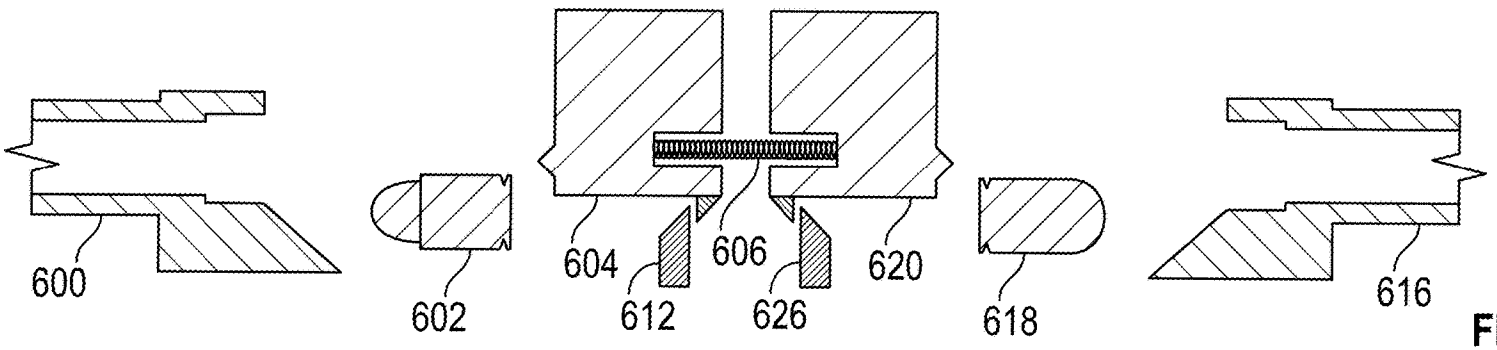
FIGS. 7A-7C show a schematic depiction of an example of a firing cycle in accordance with some example embodiments.
Figure 7B:
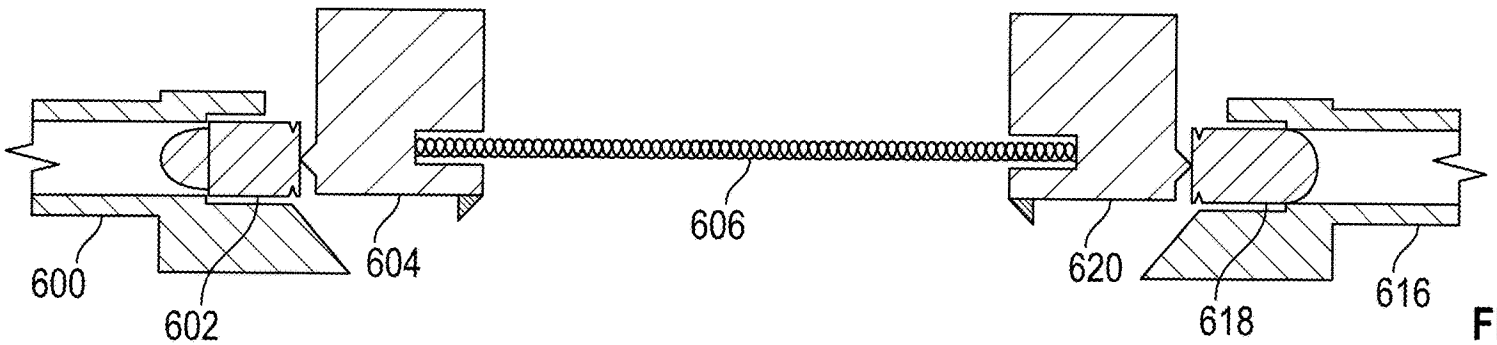
Figure 7C:
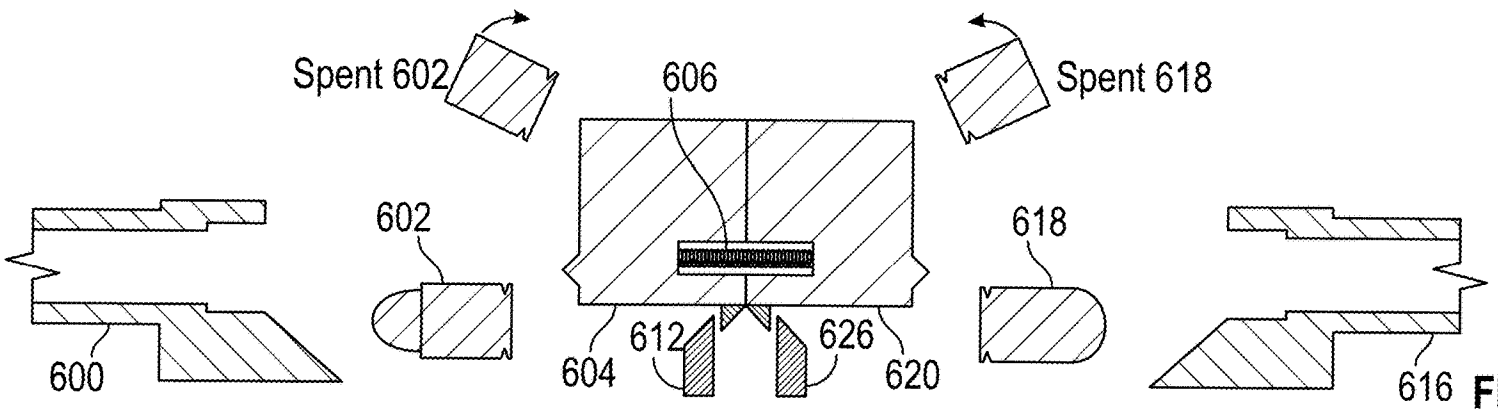

In some example embodiments, a firing cycle is illustrated in FIGS. 7A-C. As depicted in FIG. 7A, the firing cycle starts from a configuration wherein bolts 604 and 620 are each cocked in a respective open-bolt position. When sears 612 and 626 are lowered simultaneously by energizing trigger assembly 614, compressed spring 606 pushes bolt 604 towards targeting barrel 600 and loads cartridge 602 into the gun chamber. Likewise, at substantially the same time, bolt 620 is driven towards compensating barrel 616, loading blank cartridge 618. Near end of the feed phase, as depicted in FIG. 7B, fixed firing pins of said bolts encounter sufficient resistance from the cartridges to drive into primer of each cartridge before masses of the bolts collide with said barrels, igniting charges contained in each cartridge substantially simultaneously and propelling a projectile and/or propellant gases towards the respective muzzle of said barrels. The recoiling cartridge casings further drive back the bolts, preventing feed kinetic energy of the speeding bolts from being transmitted to the gun barrels and body. In this Advanced Primer Ignition mode, transmission of momentum and mechanical energy from the bolts to the gun barrels is substantially eliminated.

In the subsequent ejection phase, the recoiling bolts extract and eject spent shell casings of both barrels. Nearing end of the phase as illustrated in FIG. 7C, the bolts collide with each other, converting a portion of the recoil energy into heat and reversing respective direction of travel. Should sears 612 and 626 remain lowered, a new firing cycle commences, powered by the rebound energy and energy stored in compressed spring 606. If sears 612 and 626 are raised, firing endpoints with both bolts cocked in the respective open-bolt configuration, as depicted in FIG. 7A, readying the firearm for the next launching. Thereby, transfer of momentum or mechanical energy from the bolts to the gun barrels and body is avoided throughout the whole firing cycle in the present embodiment. Given that recoil momentum and mechanical energy are contained mostly within the reciprocating bolt group in a blowback gun system, firearms having greatly reduced or substantially no vibrations of the gun barrels and gun bodies during shooting can be constructed in accordance with some example embodiments when an Advanced Primer Ignition blowback mode of operation can be reliably employed.

It is not necessary for the bolts to collide with each other should compression spring 606 be made strong enough, in which case all recoil energy is stored in the compressed spring and utilized to drive the subsequent feed phase. It is also possible to employ movable firing pins to provide more flexible timing control of primer ignitions. Furthermore, in some example embodiments, the firearm is practiced without using Advanced Primer Ignition. In some example embodiments, for example, the firearm is configured to fully seat cartridges 602 and 618 securely inside the respective barrel chamber before the charges are ignited, in a locked-breech mode of operation benefiting improved reliability of ammunition handling in some situations. Furthermore, the firing cycle may start from an open- or closed-bolt configuration. In the embodiments without Advanced Primer Ignitions, mechanical energy carried by the bolts during the feed phase is transmitted to the gun barrels. Some transmission of the energy could still be acceptable since energy of the feed phase can be made to be only a relatively small fraction of the total recoil energy of the system.

Figure 8A:
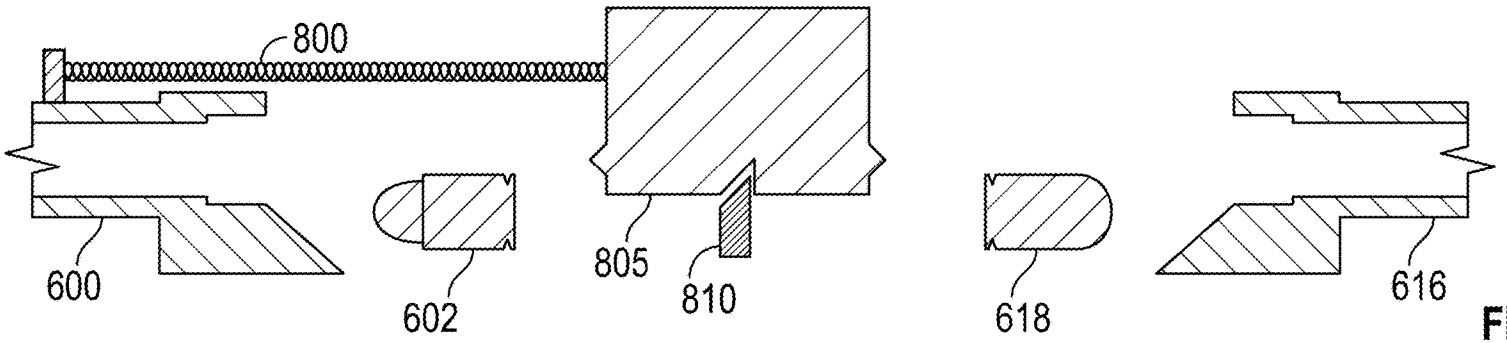
FIGS. 8A-C show a schematic depiction of an example of a firing cycle in accordance with some example embodiments.
Figure 8B:
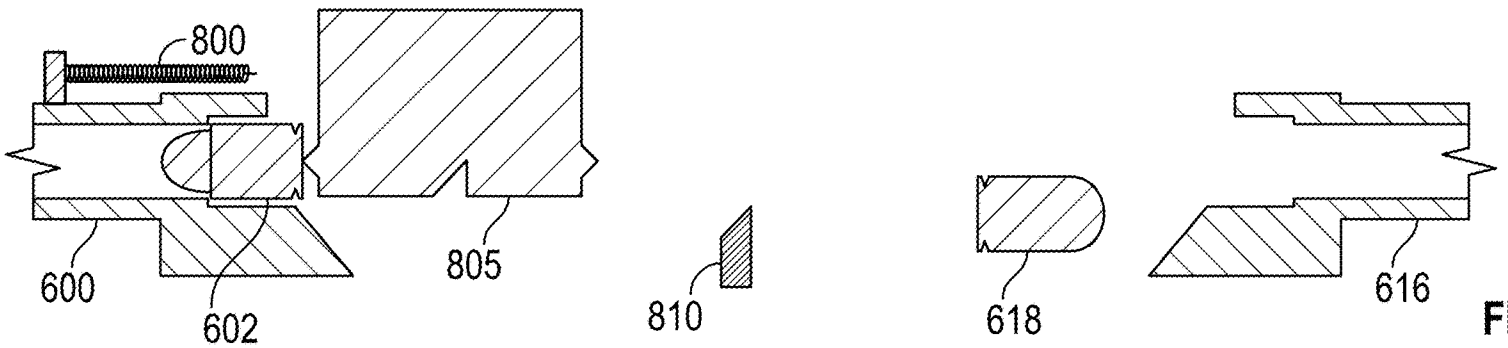
Figure 8C:
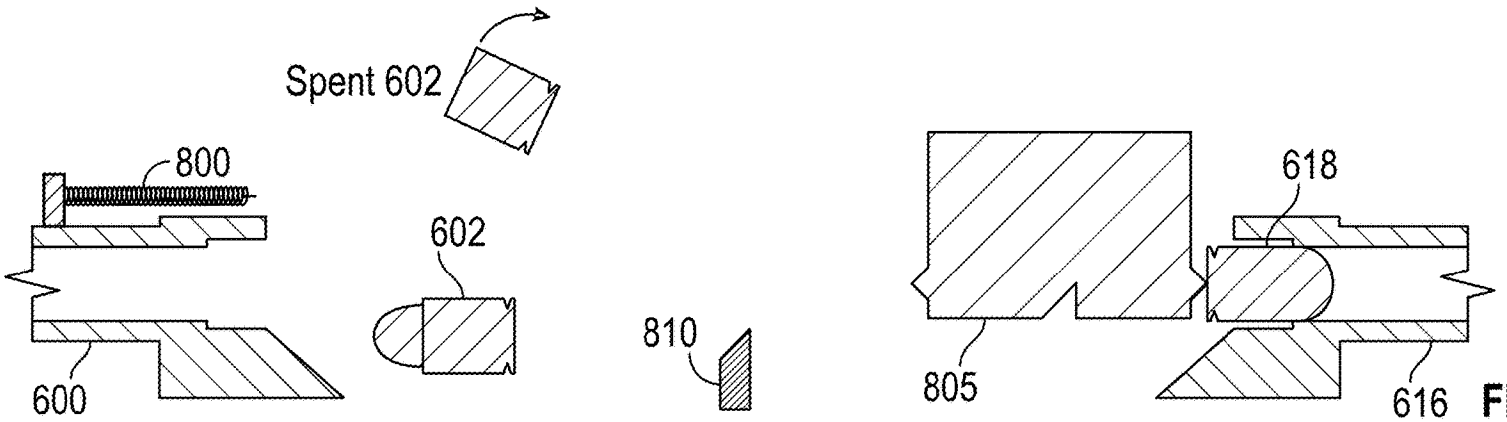

In some example embodiments, for benefits of lighter weight and more flexible timing control, the firearm depicted in FIGS. 6 and 7A-7C is modified by joining bolts 604 and 620 together to form a single bolt block 805. In some example embodiments, the weight of the bolt block 805 can be made to be approximately the same as a single bolt 604 or 620. Furthermore, sear 626 is disabled and a spring 800 removably connects bolt block 805 to the gun body. FIGS. 8A-8C illustrate configurations of this firearm during a firing cycle in the present embodiment. The cycle starts from a configuration wherein bolt block 805 is cocked in an open-bolt position as illustrated in FIG. 8A. When sear 810 is lowered, said bolt block is pulled by spring 800 towards targeting barrel 600 until said spring 800 is disengaged from said block 805 by a mechanism (not shown in FIGS. 8A-8C for simplicity) near the end of the feed phase, feeding a targeting cartridge 602 into the barrel 600, as illustrated in FIG. 8B. Said targeting cartridge is then discharged and the projectile is launched in an Advanced Primer Ignition mode, substantially eliminating transmission of momentum and mechanical energy from said block to said gun barrel and body in the process.

Subsequently, said recoiling bolt block 805 extracts and ejects said empty targeting shell casing and continues to feed a compensating cartridge 618 into the chamber of compensating barrel 616, as illustrated in FIG. 8C. Said compensating cartridge is again fired in an Advanced Primer Ignition mode, preventing transmission of momentum and mechanical energy from said block 805 to said compensating barrel 616 and body. In some example embodiments, should sear 810 remain lowered, a new firing cycle commences, energized by recoil energy from the compensating launch. If an end of firing is desired, utilizing said recoil energy, a mechanism energizes and engages spring 800 with said bolt block to return the firearm to an open bolt configuration depicted in FIG. 8A. There is no transfer of momentum or mechanical energy from the reciprocating bolt block to the gun barrels or body. Instead, an analysis indicates that recoil momentum and mechanical energy of the targeting launch is converted into muzzle momentum and energy of the subsequent compensating launch, and vice versa, during a firing cycle.

Figure 9A:
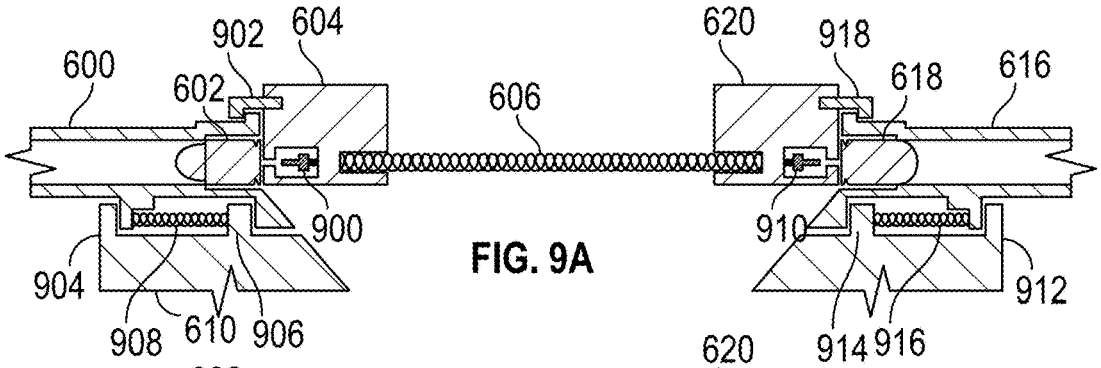
FIGS. 9A-9E show a schematic depiction of an example of a firing cycle in accordance with some example embodiments.
Figure 9B:
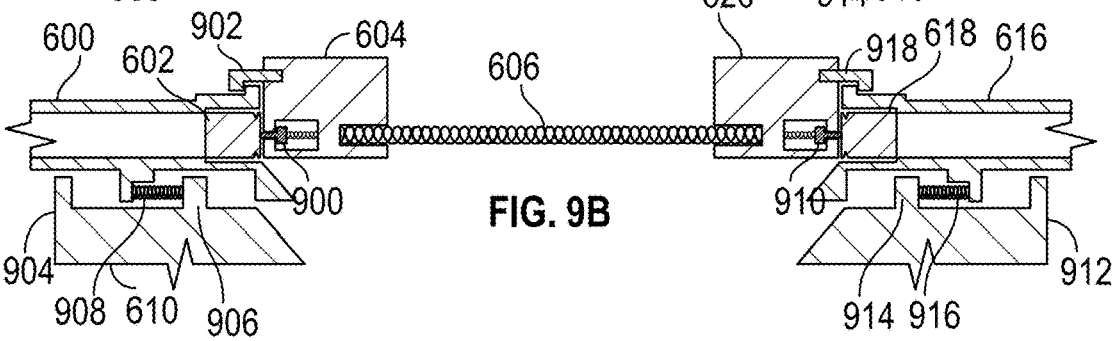

It is not always desirable to construct a firearm employing an open-breech blowback mode of operation, in part due to difficulty of cartridge casing extraction under high barrel internal pressures. In fact, many firearms in use are based on a locked-breech principle of operation. While it is inevitable that mechanical energy is transmitted to a breech-locked barrel during shooting, further transmission to the gun body can be reduced or avoided. To achieve the foregoing, in one of the preferred embodiments, the targeting and compensating barrel are each slidably mounted on the gun body and are further configured to be breech-locked with a respective bolt to facilitate a locked-breech mode of operation. FIGS. 9A-9E depicts the configurations of the firearm in a firing cycle of this embodiment. As illustrated by FIG. 9A, at the beginning of the cycle, targeting cartridge 602 is seated inside targeting barrel 600 and breech-locked via a locking mechanism 902. Said barrel is further pressed against a battery station 904 by the compressed compression spring 606. Firing pin 900 disposed inside targeting bolt 604 is cocked. Likewise, the compensating counterparts are also similarly configured. Firing starts when cocked firing pins 900 and 910 are simultaneously released, discharging both said cartridges and propelling a projectile and/or propellant gas toward respective muzzle end inside respective barrels, as well as causing a recoil of respective breech-locked barrels as depicted in FIG. 9B.

Figure 9C:
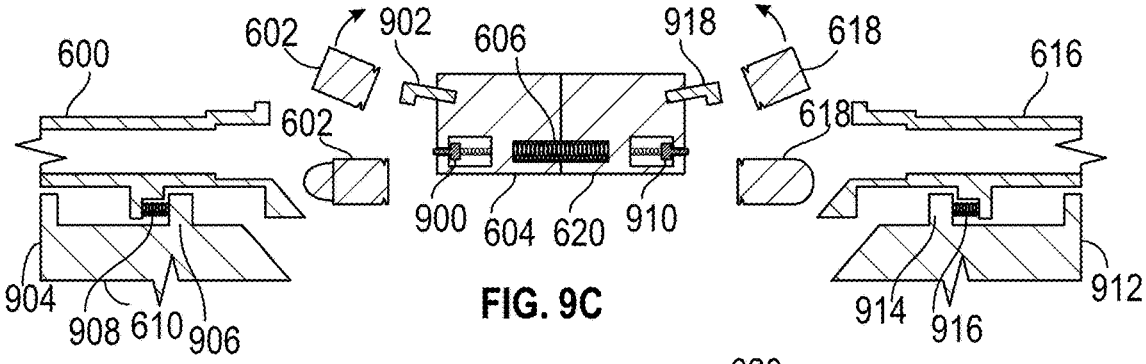
Figure 9D:
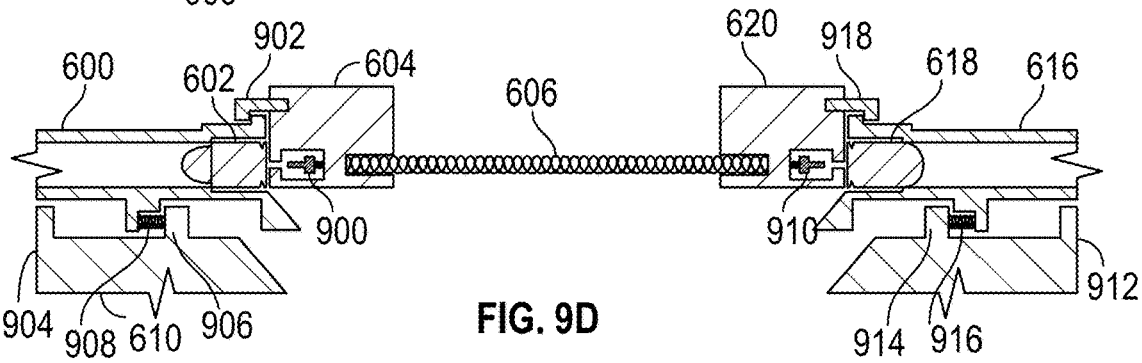
Figure 9E:
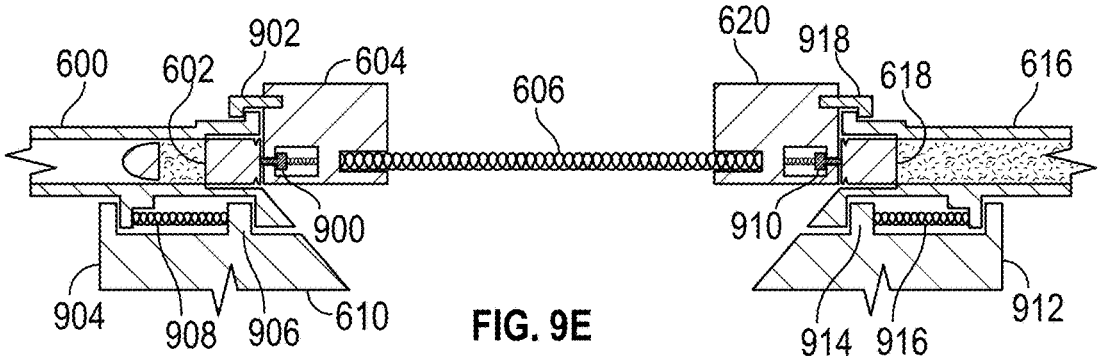

Shortly afterward, breech locks 902 and 918 unlock at a safe chamber pressure. The recoiling unlocked barrels are stopped by and held against barrel arrests 906 and 914 by barrel springs 908 and 916 (e.g., tension springs) respectively, while recoil of bolt 604 and 620 continues, extracting and ejecting spent shell casings, until mutual collision at the end of the recoil/ejection phase as depicted in FIG. 9C. During the feed phase that follows, the bolts load targeting and compensating cartridges into and breech-lock respective barrels as well as cock the firing pins, as indicated in FIG. 9D. Powered by feed kinetic energy of the bolts and energy of the compressed compression spring 606, said breech-locked barrels move towards respective battery stations 904 and 912. If a cease of firing is desired, the barrels are permitted to reach and be held at their respective battery stations 904 and 912, readying the firearm for the next launching as depicted in FIG. 9A. Should a new firing cycle be desired, the loaded targeting and compensating cartridges are discharged prior to the barrels reaching respective battery stations and the resultant recoil from the firing further separates the barrels from a respective battery station, preventing any transmission of momentum and kinetic energy from the barrels to the gun body during the feed phase. The cycle will then persist by proceeding to and continuing from configuration in FIG. 9B. There is no transmission of momentum or mechanical energy to the gun body throughout the cycle except when the recoiling gun barrels collide respectively with arrests 906 and 914 as indicated in FIG. 9C. This latter transmission at the barrel arrests can be further reduced if, instead of being fixedly disposed on the gun body, arrests 906 and 914 are solidly joined and slidably mounted on the gun body.

In a further example of the preferred embodiments, to benefit automatic recoilless launching of high impact projectiles, targeting barrel 600 and compensating barrel 616 are solidly joined and slidably mounted on the gun body 610, as illustrated by a simplified schematic drawing of FIGS. 10A-10D. Furthermore, timing for discharge of the compensating cartridge lags that of the targeting cartridge to avoid overlapping the recoil impulses and to make it possible to channel recoil energy of a targeting launch into muzzle energy of the subsequent compensating launch, thereby removing these recoil energies from the weapon system. The foregoing principle is described by referring to a firing cycle depicted in FIGS. 10A-10D.

Figure 10A:
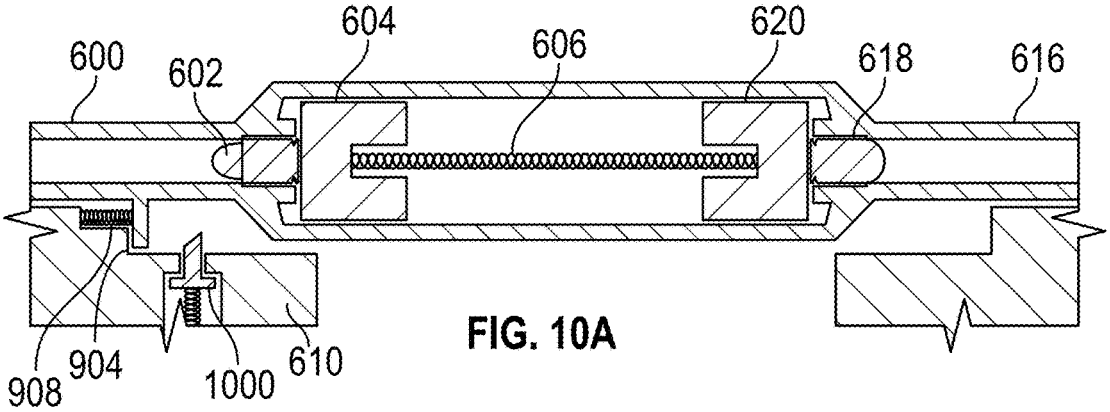
FIGS. 10A-10D show a top-down perspective of a schematic depiction of an example of a firing cycle in accordance with some of the preferred embodiments.
Figure 10B:
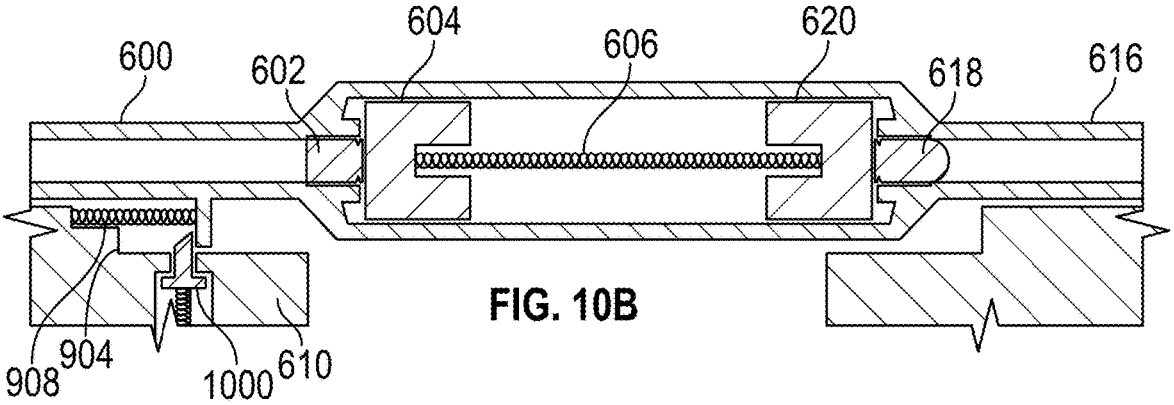
Figure 10C:
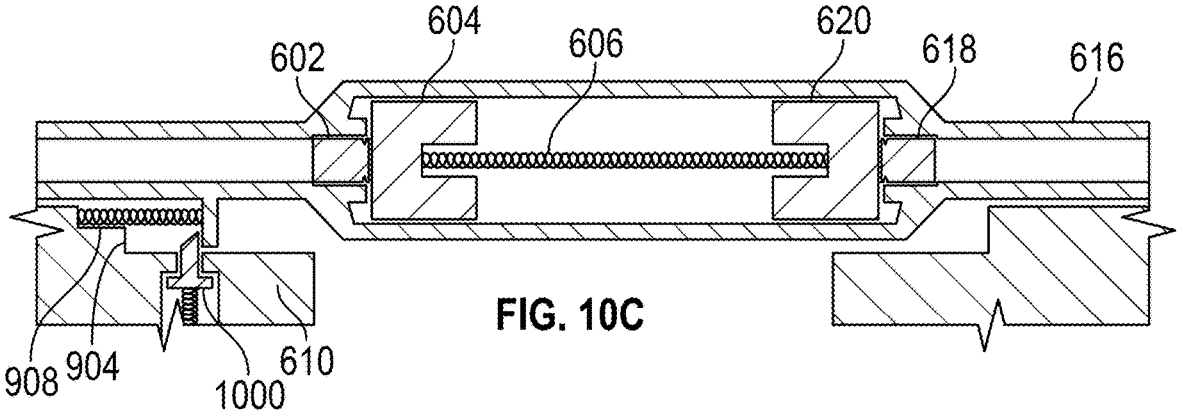
Figure 10D:
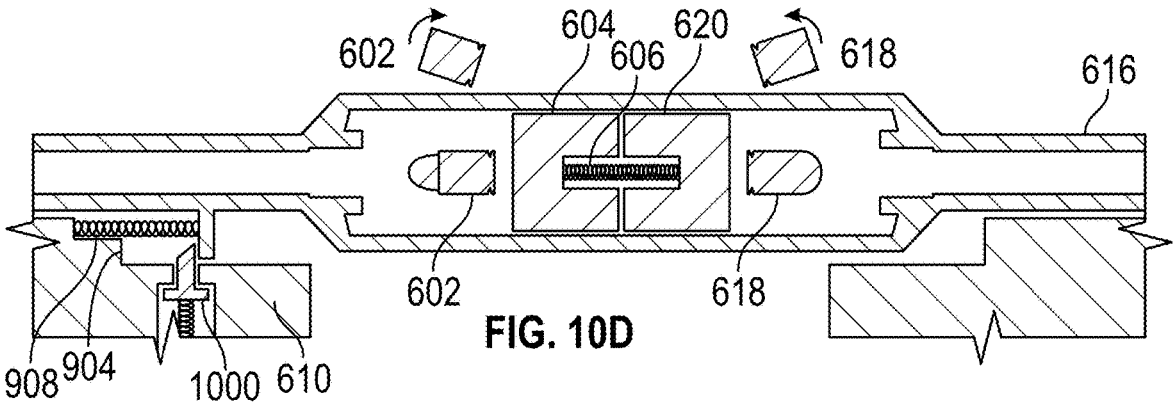

FIG. 10A depicts a configuration of the firearm at the beginning of a firing cycle. Both the targeting cartridge 602 and compensating cartridge 618 are breech-locked inside a respective chamber. The firing pins, not shown for simplicity, are cocked and the joined barrels are held against battery station 904 by barrel spring 908. Firing is initiated by a release of the targeting firing pin, which discharges the targeting cartridge, and the resulting recoil drives the still-breech-locked barrel assembly past barrel arrest 1000, as indicated in FIG. 10B. After a time-lag sufficiently long for the targeting launch recoil energy to have been fully transformed into kinetic energy of the recoiling barrel assembly, the compensating cartridge is discharged so that the resulting compensating recoil stops movement of the barrel assembly and allows barrel spring 908 to hold the barrel assembly at barrel arrest 1000, as illustrated in FIG. 10C. At the same time, some energy of the compensating launch is tapped to unlock breech-locks of both barrels at a safe compensating chamber pressure and to drive the bolts separately to extract and eject each respective spent shell casing, and to finally collide with each other at the end of the recoil phase, as depicted in FIG. 10D. The rebounding bolts then load and breech-lock a targeting and a compensating cartridge into a respective barrel chamber and disengage barrel arrest 1000 to allow the barrel assembly to return to battery station 904, as depicted in FIG. 10A, readying the firearm for the next launching.

Even though some example embodiments have been described in terms of utilizing a cartridge-based ammunition, in other example embodiments the firearm utilizes a caseless cartridge, or partially cased ammunition, in one or both barrels. When employing a caseless or partially cased ammunition, sealing of the barrel breech is achieved by the bolt in the case of employing a longitudinal-ammunition-insertion loader. In some example embodiments, the barrel breech is sealed by a fixedly closed breech in the case of a lateral revolver-style loader. Caseless or partially cased ammunitions can be beneficially utilized to enable an Advanced Primer Ignition mode of operation since casing-to-chamber wall stickiness issues, often associated with cartridge-based ammunitions, can be mitigated when caseless ammunitions are used instead.

Additionally, although some embodiments have been described in terms of allowing the bolts and/or the gun barrels to recoil in order to utilize said recoil movements to facilitate an automatic operation of the firearm, it will be apparent to those skilled in the art to recognize that some example embodiments can also be practiced by allowing the gun barrels to move towards a respective muzzle direction while holding the bolts at rest, in a blow-forward mode of operation. In the embodiments utilizing a gun barrel blow-forward mode of operation, the muzzle-wise movement of a barrel creates a spatial gap between the targeting and compensating barrel breech ends to facilitate operations of ammunition loaders.

While the devices have been described in terms of what are at present believed to be the preferred embodiments, it will be apparent to those skilled in the art that various changes may be made to these embodiments without departing from the scope of present novel embodiments. For example, although some embodiments have been described in terms of utilizing a longitudinal breech insertion mode of ammunition loading/unloading method, it will become obvious to those skilled in the arts that some embodiments are practiced utilizing a revolver-style lateral ammunition loading/unloading technique. Additionally, although some example embodiments utilize recoil energy transmitted from the cartridges to power operations of the bolt group, it will be apparent to those skilled in the art that a modified version of the system such as a delayed blowback, a recoil-operated, a gas-operated, or an externally powered mode of operation can also be applied in accordance with some example embodiments. Furthermore, various modifications to the targeting and/or compensating barrels, including but not limited to barrel porting, and/or muzzle brakes, and/or rifling that may include a compensating rifling, and/or chamber fluting can be utilized in accordance with some example embodiments. Finally, a targeting cartridge comprising more than one projectile, or a compensating cartridge comprising one projectile or a collection of projectiles of smaller diameters or even liquid projectiles, or a compensating cartridge identical to the targeting cartridge, can also be utilized, in accordance with some example embodiments.

Figure 11:
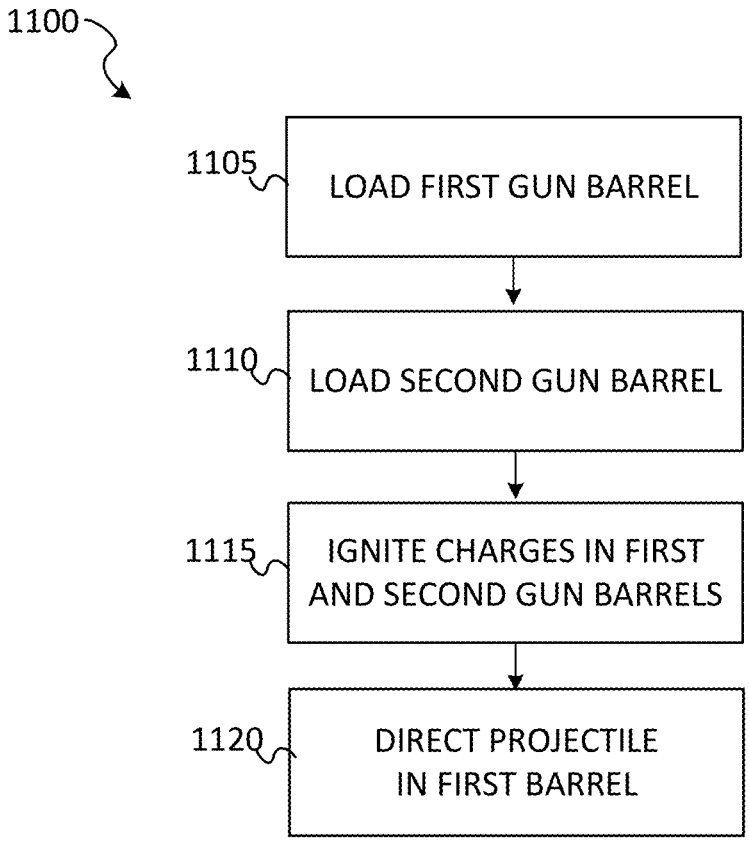
FIG. 11 shows a flow diagram of a method of operating a recoilless firearm, in accordance with some example embodiments.

FIG. 11 shows a flow diagram 1100 of a method of operating the recoilless firearm, according to some example embodiments. At operation 1105, the first gun barrel is loaded with a first cartridge. At operation 1110, the second gun barrel is loaded with a second cartridge. At operation 1115, charges in the first cartridge and second cartridge are ignited by one or more ignition devices. At operation 1120, the charge in the first cartridge causes a projectile (e.g., bullet) to be directed from the breech end to the muzzle end of the first barrel in a recoilless manner as discussed above.

In view of the disclosure above, various examples are set forth below. It should be noted that one or more features of an example, taken in isolation or combination, should be considered within the disclosure of this application.

The following are example embodiments:

Example 1. An apparatus comprising: a first gun barrel comprising openings at both ends, one of the open ends of the first gun barrel comprising a first breech and another of the open ends of the first gun barrel comprising a first muzzle; a second gun barrel comprising openings at both ends, one of the ends of the second gun barrel comprising a second breech and another of the open ends of the second gun barrel comprising a second muzzle, the second gun barrel being coaxially aligned with the first gun barrel, the second breech of the second gun barrel facing the first breech of the first gun barrel, the first breech and the second breech being separated by a gap; a first cartridge in the first breech of the first gun barrel, a second cartridge in the second breech of the second gun barrel, an ignition device configured to ignite charges in the first cartridge and the second cartridge to launch the first cartridge in the first gun barrel and launch the second cartridge in the second gun barrel.

Example 2. The apparatus of examples 1, wherein the ignition device is configured to ignite charges in the first cartridge and the second cartridge at a same time.

Example 3. The apparatus of any of examples 1 or 2, wherein the ignition device is configured to ignite the charges in the first cartridge and the second cartridge with a lag between ignition of the charges in the first cartridge and the second cartridge.

Example 4. The apparatus of any of examples 1-3, wherein the first cartridge comprises a bullet and the second cartridge is a blank cartridge.

Example 5. The apparatus of any of examples 1-4, further comprising: a first loader to automatically load cartridges in the first gun barrel.

Example 6. The apparatus of any of examples 1-5, further comprising: a second loader to automatically load cartridges in the second gun barrel.

Example 7. The apparatus of any of examples 1-6, wherein the first loader comprises a first bolt at least part of which is slidably disposed between the first breech and the second breech, and wherein the second loader comprises a second bolt at least part of which is slidably disposed between the first bolt and the second breech of the second gun barrel.

Example 8. The apparatus of any of examples 1-7, wherein the first bolt and second bolt are configured to undergo an elastic or inelastic mutual collision in a process of a projectile launching.

Example 9. The apparatus of any of examples 1-8, wherein the second gun barrel comprises a varying inner diameter along a length of the second gun barrel.

Example 10. The apparatus of any of examples 1-9, further comprising a first loader for the first gun barrel and a second loader for the second gun barrel, wherein the first loader and the second loader comprise a common bolt block that is slidably disposed between the first breech of the first gun barrel and the second breech of the second gun barrel.

Example 11. The apparatus of any of examples 1-10, wherein the common bolt block alternately functions as a bolt for the first loader and the second loader.

Example 12. The apparatus of any of examples 1-11, wherein said the first gun barrel and the second gun barrel are slidably disposed on a gun body of the apparatus, and the ignition device is configured to discharge the first cartridge and the second cartridge substantially simultaneously.

Example 13. The apparatus of any of examples 1-12, wherein the first gun barrel and the second gun barrel are joined and disposed on a gun body of the apparatus, and wherein the ignition device is configured to discharge the first cartridge and the second cartridge with a time lag between discharges.

Example 14. The apparatus of any of examples 1-13, wherein the first cartridge and the second cartridge each comprise a case that includes a propellant, and wherein the first cartridge further comprises a bullet fixed to one end of the case of the first cartridge.

Example 15. The apparatus of any of examples 1-14, wherein, in response to the ignition device igniting the first cartridge and second cartridge, the first cartridge seals the first breech of the first gun barrel and the second cartridge seals the second breech of the second gun barrel.

Example 16. The apparatus of any of examples 1-15, wherein the first cartridge comprises a caseless cartridge and a first loader of the first gun barrel comprises a bolt that is configured to seal the first breech upon ignition of the first cartridge.

Example 17. The apparatus of any of examples 1-16, wherein the second cartridge comprises a caseless cartridge and a second loader of the second gun barrel comprises a bolt that is configured to seal the second breech upon ignition of the second cartridge.

Example 18. A method comprising: loading a first cartridge in a first gun barrel of a gun device, the first gun barrel comprising openings at both ends, one of the open ends of the first gun barrel comprising a first breech and another of the open ends of the first gun barrel comprising a first muzzle; loading a second cartridge in a second gun barrel of the gun device, the second gun barrel comprising openings at both ends, one of the ends of the second gun barrel comprising a second breech and another of the open ends of the second gun barrel comprising a second muzzle, the second gun barrel being coaxially aligned with the first gun barrel, the second breech of the second gun barrel facing the first breech of the first gun barrel, the first breech and the second breech being separated by a gap; and igniting, using an ignition device of the gun device, the first cartridge in the first gun barrel and the second cartridge in the second gun barrel.

Example 19. The method of example 18, wherein the ignition device is configured to ignite charges in the first cartridge and the second cartridge at a same time.

Example 20. The method of any of examples 18 or 19, wherein the ignition device is configured to ignite the charges in the first cartridge and the second cartridge with a lag between ignition of the charges in the first cartridge and the second cartridge.

In the foregoing detailed description, the method and apparatus of the present inventive subject matter have been described with reference to specific exemplary embodiments thereof. It will, however, be evident that various modifications and changes may be made thereto without departing from the broader spirit and scope of the present inventive subject matter. The present specification and figures are accordingly to be regarded as illustrative rather than restrictive.

What is claimed is:

1. An apparatus comprising:

a first gun barrel comprising openings at both ends, one of the open ends of the first gun barrel comprising a first breech and another of the open ends of the first gun barrel comprising a first muzzle;

a second gun barrel comprising openings at both ends, one of the ends of the second gun barrel comprising a second breech and another of the open ends of the second gun barrel comprising a second muzzle, the second gun barrel being coaxially aligned with the first gun barrel, the second breech of the second gun barrel facing the first breech of the first gun barrel, the first breech and the second breech being separated by a gap;

a first cartridge in the first breech of the first gun barrel;

a second cartridge in the second breech of the second gun barrel;

an ignition device configured to ignite charges in the first cartridge and the second cartridge to launch the first cartridge in the first gun barrel and launch the second cartridge in the second gun barrel;

a first loader to automatically load cartridges in the first gun barrel; and a second loader to automatically load cartridges in the second gun barrel.

2. The apparatus of claim 1, wherein the ignition device is configured to ignite charges in the first cartridge and the second cartridge at a same time.

3. The apparatus of claim 1, wherein the ignition device is configured to ignite the charges in the first cartridge and the second cartridge with a lag between ignition of the charges in the first cartridge and the second cartridge.

4. The apparatus of claim 1, wherein the first cartridge comprises a bullet or multiple projectiles and the second cartridge is a blank cartridge or a cartridge comprising one or more projectiles.

5. The apparatus of claim 1, wherein the first loader comprises a first bolt at least part of which is slidably disposed between the first breech and the second breech, and wherein the second loader comprises a second bolt at least part of which is slidably disposed between the first bolt and the second breech of the second gun barrel.

6. The apparatus of claim 5, wherein the first bolt and second bolt are configured to undergo an elastic or inelastic mutual collision in a process of a projectile launching.

7. The apparatus of claim 5, further comprising a collision buffer disposed between the first bolt and the second bolt.

8. The apparatus of claim 7, wherein the collision buffer comprises a spring.

9. The apparatus of claim 5, wherein the ignition device comprises a first firing pin fixedly disposed on a surface of the first bolt and a second firing pin fixedly disposed on a surface of the second bolt.

10. The apparatus of claim 5, wherein the ignition device comprises a first firing pin slidably disposed inside the first bolt and a second firing pin slidably disposed inside the second bolt.

11. The method of claim 8, wherein the first cartridge carrier device comprises a first bolt and the second cartridge carrier device comprises a second bolt.

12. The apparatus of claim 1, wherein the second gun barrel comprises a varying inner diameter along a length of the second gun barrel.

13. The apparatus of claim 1, further comprising a first loader for the first gun barrel and a second loader for the second gun barrel, wherein the first loader and the second loader comprise a common bolt block that is slidably disposed between the first breech of the first gun barrel and the second breech of the second gun barrel.

14. The apparatus of claim 13, wherein the common bolt block alternately functions as a bolt for the first loader and the second loader.

15. The apparatus of claim 1, wherein the first gun barrel and the second gun barrel are slidably disposed on a gun body of the apparatus, and the ignition device is configured to discharge the first cartridge and the second cartridge substantially simultaneously.

16. The apparatus of claim 1, wherein the first gun barrel and the second gun barrel are joined and disposed on a gun body of the apparatus, and wherein the ignition device is configured to discharge the first cartridge and the second cartridge with a time lag between discharges.

17. The apparatus of claim 1, wherein the first cartridge and the second cartridge each comprise a case that includes a propellant, and wherein the first cartridge further comprises a bullet fixed to one end of the case of the first cartridge.

18. The apparatus of claim 1, wherein, in response to the ignition device igniting the first cartridge and second cartridge, the first cartridge seals the first breech of the first gun barrel and the second cartridge seals the second breech of the second gun barrel.

19. The apparatus of claim 1, wherein the first cartridge comprises a caseless cartridge and a first loader of the first gun barrel comprises a bolt that is configured to seal the first breech upon ignition of the first cartridge.

20. The apparatus of claim 1, wherein the second cartridge comprises a caseless cartridge and a second loader of the second gun barrel comprises a bolt that is configured to seal the second breech upon ignition of the second cartridge.

21. A method comprising:

automatically loading a first cartridge in a first gun barrel of a gun device, the first cartridge being transported by a first cartridge carrier device, the first gun barrel comprising openings at both ends, one of the open ends of the first gun barrel comprising a first breech and another of the open ends of the first gun barrel comprising a first muzzle;

automatically loading a second cartridge in a second gun barrel of the gun device, the second cartridge being transported by a second cartridge carrier device, the second gun barrel comprising openings at both ends, one of the ends of the second gun barrel comprising a second breech and another of the open ends of the second gun barrel comprising a second muzzle, the second gun barrel being coaxially aligned with the first gun barrel, the second breech of the second gun barrel facing the first breech of the first gun barrel, the first breech and the second breech being separated by a gap; and igniting, using an ignition device of the gun device, the first cartridge in the first gun barrel and the second cartridge in the second gun barrel.

22. The method of claim 21, wherein the ignition device is configured to ignite charges in the first cartridge and the second cartridge at a same time.

23. The method of claim 21, wherein the ignition device is configured to ignite the charges in the first cartridge and the second cartridge with a lag between ignition of the charges in the first cartridge and the second cartridge.

24. The method of claim 21, wherein the first gun barrel breech is removably joined with the first cartridge carrier device for a duration before the ignition of the first cartridge and further for a duration after the ignition of the first cartridge, the second gun barrel breech is removably joined with the second cartridge carrier device for a duration before the ignition of the second cartridge and further for a duration after the ignition of the second cartridge.

25. The method of claim 21, further comprising:

absorbing, using an energy storage device of the gun device, energy of the first cartridge carrier device for a pre-determined duration after the ignition of the first cartridge and energy of the second cartridge carrier device for a pre-determined duration after the ignition of the second cartridge; and releasing, using an energy storage device of the gun device, energy to the first cartridge carrier device for a pre-determined duration before the ignition of the first cartridge and energy to the second cartridge carrier device for a pre-determined duration before the ignition of the second cartridge.

26. The method of claim 25, wherein the energy storage device comprises of a spring.

27. The method of claim 25, wherein the ignition device is configured to ignite charges in the first cartridge a predetermined first cartridge ignition lead time before the first cartridge arrives at a resting position of the first cartridge or before the first cartridge carrier device arrives at a resting position of the first cartridge carrier device, and to ignite charges in the second cartridge a predetermined second cartridge ignition lead time before the second cartridge arrives at a resting position of the second cartridge or before the second cartridge carrier device arrives at a resting position of the second cartridge carrier device.

28. The method of claim 27, wherein the first cartridge ignition lead time is further configured to prevent the first cartridge from reaching the resting position of the first cartridge or to prevent the first cartridge carrier device from reaching the resting position of the first cartridge carrier device, and the second cartridge ignition lead time is further configured to prevent the second cartridge from reaching the resting position of the second cartridge or to prevent the second cartridge carrier device from reaching the resting position of the second cartridge carrier device.

29. The method of claim 25, further comprising:

reducing or eliminating movement frictions of components of the gun device in an operation of the gun device.

* * * * *